US005131544A

United States Patent [19]

Serres et al.

[11] Patent Number: 5,131,544

[45] Date of Patent: Jul. 21, 1992

[54] DEVICE FOR SELECTIVELY SEPARATING PARTICLES IN A LIQUID, IN PARTICULAR FOR CLEANING FIBROUS PAPER SUSPENSING

[75] Inventors: Alain Serres, Vitry le Francois; Francois Julien Saint Amand, Le Touvet, both of France

[73] Assignees: E. et M. Lamort, Vitry le Francois; Centre Technique de l'Industrie des Papiers, Cartons et Celluloses, Grenoble, both of France

[21] Appl. No.: 477,904

[22] PCT Filed: Sep. 12, 1989

[86] PCT No.: PCT/FR89/00458

§ 371 Date: Apr. 30, 1990

§ 102(e) Date: Apr. 30, 1990

[87] PCT Pub. No.: WO90/02839

PCT Pub. Date: Mar. 22, 1990

[30] Foreign Application Priority Data

Sep. 13, 1988 [FR] France ..... 88 12156

[51] Int. Cl.[5] ..... B03D 00/00

[52] U.S. Cl. ..... 209/210; 209/208; 209/211; 210/360.1; 210/512.1

[58] Field of Search ..... 209/155, 208, 210, 211; 210/512.1, 512.3, 360.1

[56] References Cited

U.S. PATENT DOCUMENTS

| | | | |
|---|---|---|---|
| 2,748,668 | 6/1956 | Hornbostel | 92/28 |
| 4,332,350 | 6/1982 | McGlellan | 233/7 |
| 4,443,331 | 4/1984 | Julien Saint Amand | 209/211 |
| 4,533,468 | 8/1985 | Ensor et al. | 210/512.3 X |

FOREIGN PATENT DOCUMENTS

| | | | |
|---|---|---|---|
| 0037347 | 10/1981 | European Pat. Off. . | |
| 1115888 | 12/1954 | France | 209/211 |
| 1450895 | 7/1966 | France . | . |
| 1366170 | 9/1974 | Greece . | |
| 0417167 | 7/1974 | U.S.S.R. | 209/211 |
| 952350 | 8/1982 | U.S.S.R. | 209/211 |

*Primary Examiner*—Donald T. Hajec
*Assistant Examiner*—Joseph A. Kaufman
*Attorney, Agent, or Firm*—Sughrue, Mion, Zinn Macpeak & Seas

[57] ABSTRACT

A device for separating particles in a liquid in which a paper suspension is to be cleaned and supplied to a chamber of revolution (1) rotating about an axis (2). Movable deviators (7, 8) precede the fixed outlets (9, 10) to intercept most of the through-put of the suspension in the region of the periphery of the chamber (1), then deviate it towards the longitudinal axis of rotation (2) so as to recover most of the kinetic energy of rotation. The outlets (7, 8, 9, 10) are situated at the opposite end to that of chamber (1) from the supply (5, 6) and are arranged at the periphery of this chamber (1). A diabolo-shaped central body of revolution (11) is arranged inside the chamber, along the longitudinal axis of rotation (2) for rotation about its axis and with a radial run-off (12) in the vicinity of its smallest cross-section connected to an axial outlet duct (13).

8 Claims, 3 Drawing Sheets

DEVICE FOR SELECTIVELY SEPARATING PARTICLES IN A LIQUID, IN PARTICULAR FOR CLEANING FIBROUS PAPER SUSPENSING

FIELD OF THE INVENTION

The invention relates to a device for selectively separating particles in a liquid, in particular in a suspension. The invention is particularly suitable for the paper industry, in particular the cleaning of particulate suspensions, for example fibrous suspensions. The invention may, however, find other applications in separation or centrifugal fractioning techniques, in the recovery of immiscible liquids of differing densities, etc.

BACKGROUND OF THE INVENTION

There currently exists in the paper industry a large number of apparatuses intended for the cleaning or separation of fibrous suspensions.

In the document EP-B-0,037,347 of the Applicant (corresponding to U.S. Pat. No. 4,443,331), a free vortex device has been proposed, in which the suspension to be cleaned is supplied to a chamber of revolution rotating about its axis, of the type comprising:

fixed means for supplying the suspension, arranged along the longitudinal axis of said chamber of revolution, extended by movable means for deviating the suspension current towards the periphery of the chamber;

means for driving said chamber in rotation about its longitudinal axis;

fixed means for discharging the cleaned suspension and various separated fractions, arranged along the longitudinal axis of said chamber, preceded by movable deviating means and in which the means for discharging the lightest components is arranged along the longitudinal axis of rotation (2) on the same side as the supply means, wherein:

the movable deviating means preceding the fixed outlet means intercept most of the throughput of the suspension in the region of the periphery of the chamber, then deviate it towards the longitudinal axis of rotation, so as to recover most of the kinetic energy of rotation;

and wherein the main outlet means are situated at the opposite end to that of the chamber comprising the supply means and are arranged at the periphery of this chamber, so that a large central centrifugal zone is available.

This device provides excellent results as regards efficiency, reject rate and energy consumption, in particular for outputs less than about three hundred cubic meters per hour of diluted pulp (concentration of the order of 1%). In order to treat effectively higher outputs, i.e. throughputs greater than 300 cubic meters per hour of diluted pulp, it becomes necessary to increase the volume of the apparatus and hence its diameter. These large apparatus with a high cleaning capacity thus have various drawbacks depending on the conditions of their use.

Thus, if diluted pulp is being treated, there is first of all an increase in the pressure drop in the region of the bearings and the inlet/outlet ends, as well as in the peripheral cleaning zone, on account of the need to maintain sufficient turbulence with a high throughput. Furthermore, again in the case of diluted pulp, it becomes necessary, on account of the larger diameter, to increase the counterpressure at the outlet in order to extract the rejects intercepted along the axis of the central zone of the vortex, or alternatively to intercept it at the periphery of this zone: there is thus formed along the axis of the apparatus an air core which, having no fixed geometry, moves inside the suspension and generates vibrations throughout the body of the apparatus.

If treating pulp with a higher concentration (up to about (3)% (sic), the problems which arise are different. First of all, owing to the centrifugal force effect, the pulp tends to accumulate against the walls, thus also resulting in the risks of vibrations due to imbalances and clogging of the apparatus by very concentrated pulp. Furthermore, in order to individualize the movement of the fibers, it is necessary to maintain a high degree of turbulence and, for this reason, a big difference in peripheral/wall flow speeds, thus resulting in high pressure losses. Moreover, control of the flow at the periphery of the vortex, by the geometry of the ends, and that of the body of the apparatus essentially for small diameters, is fairly delicate and poses problems as regards homogeneity of flow, which may adversely affect the quality of cleaning and which result in the risk of deposits.

SUMMARY OF THE INVENTION

The present invention overcomes these drawbacks.

It relates to an improved device of the same type as that described in the document EP-B-0,037,347, in which control of the flow in the peripheral cleaning zone is improved and evacuation of the light reject in the central zone of the vortex is promoted, even in the case of high throughputs, while ensuring stable operation of the apparatus.

The subject of the invention is also an improved device of the type in question enabling large quantities of pulps of the order of five hundred meters cubed per hour (500 $m^3/h$) and more to be cleaned.

This improved device for separating particles in a liquid, in which the suspension to be cleaned is supplied to a chamber of revolution rotating about a longitudinal axis, of the type comprising:

fixed means for supplying the suspension, arranged along the longitudinal axis of the chamber of revolution, extended by movable means for deviating the suspension current towards the periphery of the chamber;

means for driving said chamber in rotation about its longitudinal axis;

fixed means for discharging the cleaned suspension and the different separated fractions, arranged along the longitudinal axis of said chamber, preceded by movable deviating means and in which the means for discharging the lightest components is arranged on the longitudinal axis of rotation, either on the side where the suspension to be cleaned is admitted or on the side where the cleaned suspension is discharged, and in which:

the movable deviating means preceding the fixed outlet means intercept most of the throughput of the suspension in the region of the periphery of the chamber, then deviate it towards the longitudinal axis of rotation so as to recover most of the kinetic energy of rotation;

the outlet means are situated at the opposite end to that of the chamber comprising the supply means and are arranged at the periphery of this chamber;

wherein moreover a central body of revolution is arranged inside this chamber along the longitudinal axis of rotation of the chamber, between the means supplying the suspension and the means discharging the cleaned suspension, the said central body of revolution:

having a general convergent shape from the inlet means towards the outlet means;

and comprising a run-off means arranged in the vicinity of the smallest cross-section of said central body of revolution, connected to an axial outlet duct.

In other words, the invention consists in providing in the device described in the document EP-B-0,037,347 of the Applicant, a single rigid central body with a general tapered and convergent shape inside the chamber, which occupies the decreasing part of the gap between the supply and outlet means, associated with a run-off means arranged in the vicinity of its smallest cross-section and intended to extract the light fraction of the suspension.

The run-off system provided in the central body of revolution of the apparatus converts the residual energy of the vortex (dynamic and static pressures) into static pressure. This avoids the counterpressure on the outlet side and therefore enables the inlet pressure to be correspondingly reduced, resulting in an appreciable saving in energy.

Advantageously:

the gap between the inner wall of the chamber and the wall of the central body increases gradually from the inlet towards the outlet;

the chamber has an inner cylindrical general shape and the characteristic central body has a diabolo shape;

the diabolo-shaped central body comprises three distinct portions, namely:

a first frustoconical portion, tapered towards the outlet;

a second cylindrical portion connected to the first portion, having at its periphery orifices associated with the run-off means;

a third portion, also frustoconical, but with a conicity which is opposite to that of the first portion, connected to the second cylindrical portion and having an axial duct associated with the run-off means and intended to extract the light fraction;

the run-off means consist of radial fins associated with the peripheral orifices of the second cylindrical portion;

the inlet and outlet ends of the central body are integral with the chamber of revolution and are driven in rotation by a single motor at the same speed as the speed of rotation of said chamber;

the central body is driven in rotation at a speed which is different from that of the chamber, but is integral with the inlet and/or outlet ends of the chamber; in this case, the central body advantageously has fins at the periphery, arranged along a generatrix.

In the sector of centrifuges, or centrifugal settlers, it has been known for a long time to arrange, inside the rotor, a central body substantially of revolution and with a shape similar to the general inner shape of the rotor. This shape defines a flow space with a substantially constant thickness so as to avoid any unfavorable agitation during the settling of the suspension. This central body generally has scraping or run-off elements for the heavy particles which have settled against the inner wall of the rotor so as to return them to the vicinity of the axis and to extract them from the apparatus (see, for example, FR-A-1,450,895 (corresponding to U.S. Pat. No. 3,467,304); U.S. Pat No. 4,332,350 or GB-A-1,366,170). On the other hand, in the device of the invention, the central body of necessity has a shape which is different from the inner wall of the chamber, in particular at the level of the run-off devices, so as to return to the vicinity of the central body, and to extract in the axis, not only the heavy particles, but also the light fraction of the suspension.

Thus, for the extraction of the light fractions, the state of the art argued against the use of a central body.

In other words, the invention consists, for this new application and in order to obtain the objective of extracting the light fraction, in defining a particular and specific shape for the central body relative to the inner wall of the chamber, namely a convergent shape, and in positioning the run-off point on this central body at the point with the smallest cross-section.

If the central body is integral with the rotating chamber of the apparatus, the apparatus is in this case particularly suitable for the sector of fine cleaning into diluted pulp, since the presence of the central body allows the flow to be channeled more effectively, in particular upon leaving the injection channels of the inlet end. In fact, the parasitic recirculation currents as well as the radial variations in angular speed of the pulp are reduced, thereby making the flow more uniform, in particular with a more homogeneous turbulent condition.

On the other hand, if the central body is driven in rotation separately from the rotating body of the apparatus, but integrally with the suspension inlet and/or outlet end(s), the apparatus is thus perfectly suited to the cleaning of more concentrated suspensions. In fact, control of the flow in the external peripheral zone is improved not only by the presence of the central body but also by the choice of its rotational speed differential, which enables the pulp to be entrained in rotation again, so that the suspension retains an optimum degree of turbulence. In practice, the rotational speed differential of the central body is chosen according to the difference in speed of the suspension relative to the wall in the region of the injection zone, depending on the characteristics of the supply end.

The chamber, the supply means, the movable deviating means, the outlet means and the rotational driving means are made in a known manner, notably in accordance with the teachings of the document EP-B-0,037,347 referred to in the preamble, for example from stainless steel.

The convergent central body has the following characteristics:

a conical (diabolo) shape converging from the suspension supply and outlet ends enables the light reject to be properly evacuated, by promoting the displacement of the light components towards the extraction zone which may be situated at any level between the ends, and in particular towards the outlet end, where the latter comprises the axial tube for evacuation of the light reject;

the diameter of the run-off, arranged at the point of the diabolo with the smallest cross-section, must be sufficiently great in order to avoid the formation of the air core and in order to recover the residual pressure necessary for the extraction of the light fraction, but it must also be substantially less than the internal diameter of the chamber in order to avoid the simultaneous extraction of heavy particles;

the diameter of the central body in the region of the supply and outlet ends must be fairly large in order to control properly the flow in the peripheral cleaning zone, and more particularly in the region of the supply end, so as to channel the parasitic currents more effectively; in the case where the central body is driven in rotation separately from the body of the apparatus, this central body may advantageously be equipped with elements for re-entrainment of the suspension, such as radial fins arranged longitudinally on its surface and more or less close to the wall according to the shearing, and hence the turbulence required.

For technical and mechanical reasons, the inner wall of the chamber is cylindrical. A slightly frustoconical general shape could, if required, be used with the proviso that, as already stated, the distance between the walls of the chamber and of the central body increases uniformly from the inlet towards the run-off device. This slightly frustoconical arrangement entails, however, an increased construction cost which is not essential.

The manner in which the invention may be achieved and the advantages arising therefrom will emerge more clearly from the examples of embodiment taken in conjunction with the attached figures.

DETAILED DESCRIPTION OF THE DRAWINGS

FIG. 3 shows in basic schematic form, in longitudinal cross-section, a preferred embodiment of the invention, whereas

DESCRIPTION OF THE PREFERRED EMBODIMENTS

Figure 1:
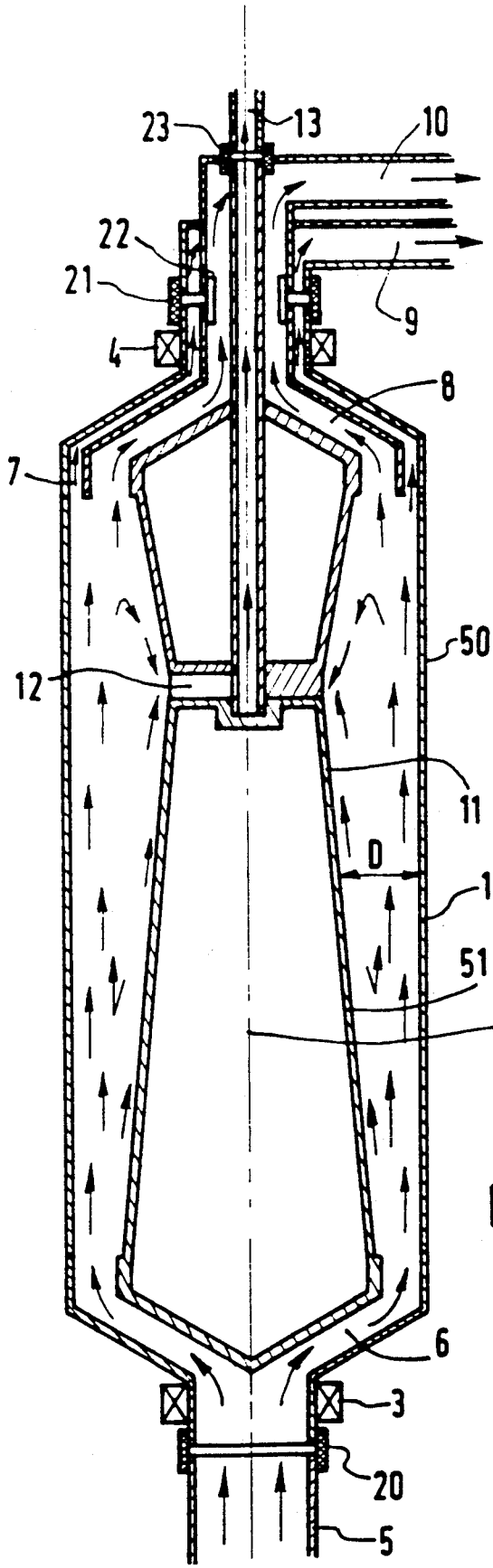
FIG. 1 shows in basic schematic form, in longitudinal cross-section, an apparatus in which the characteristic central body is integral with the chamber of the apparatus.

With reference to FIG. 1, the cleaning apparatus consists of:

an internally and externally cylindrical hollow chamber (1) driven in rotation about its longitudinal axis (2), by known means, not shown (motor);

bearings (3) and (4), associated with conventional seals (20–24), allowing the chamber (1) to rotate about its axis (2);

a tube (5) forming a fixed means for supplying the suspension to be cleaned and leading by means of a connection piece rotating at the end of the chamber (1) into a supply duct (6) forming a movable deviating means;

opposite the inlet means (5,6) and opposite the assembly (1), outlet means also formed by two fixed ducts (9,10) forming fixed outlet means, connected via rotating connection pieces, respectively to the duct (7) closest to the outlet periphery, for the extraction of the heaviest particles and to the concentric outlet duct (8), for the extraction of the intermediate fraction;

a diabolo-shaped rigid characteristic central body of revolution (11) aligned on the longitudinal axis (2) and fixed to the chamber (1) by sealed means (not shown); this central body (11) comprises a radial run-off or radial passage means (12) (having an inlet remote from the axis of the chamber 1) situated in the smallest cross-section of the diabolo and open to the chamber to collect the lightest fraction of the suspension closest to the axis of rotation (2); consequently, the distance D (FIG. 3) between the inner cylindrical wall of the chamber (1) and the wall (51) of the diabolo (11,30) increases uniformly from the inlet (5,6) towards the outlet (7,8);

an outlet duct (13) for the cleaned suspension, open to the radial inner end of the run-off (12) and along the longitudinal axis (2) of the chamber (1), for eliminating the lightest fraction of the suspension collected by the run-off (12).

This therefore constitutes an improved cleaner of the type described in the aforementioned document EP-B-0,037,347, having a cylindrical chamber (1) in which is arranged a diabolo-shaped single central body (11) with a run-off (12) in the smallest cross-section, which promotes the removal of light reject, reduces the pressures necessary for effective operation of the cleaner, avoids vibration problems and improves the homogeneity of the suspension.

Figure 2:
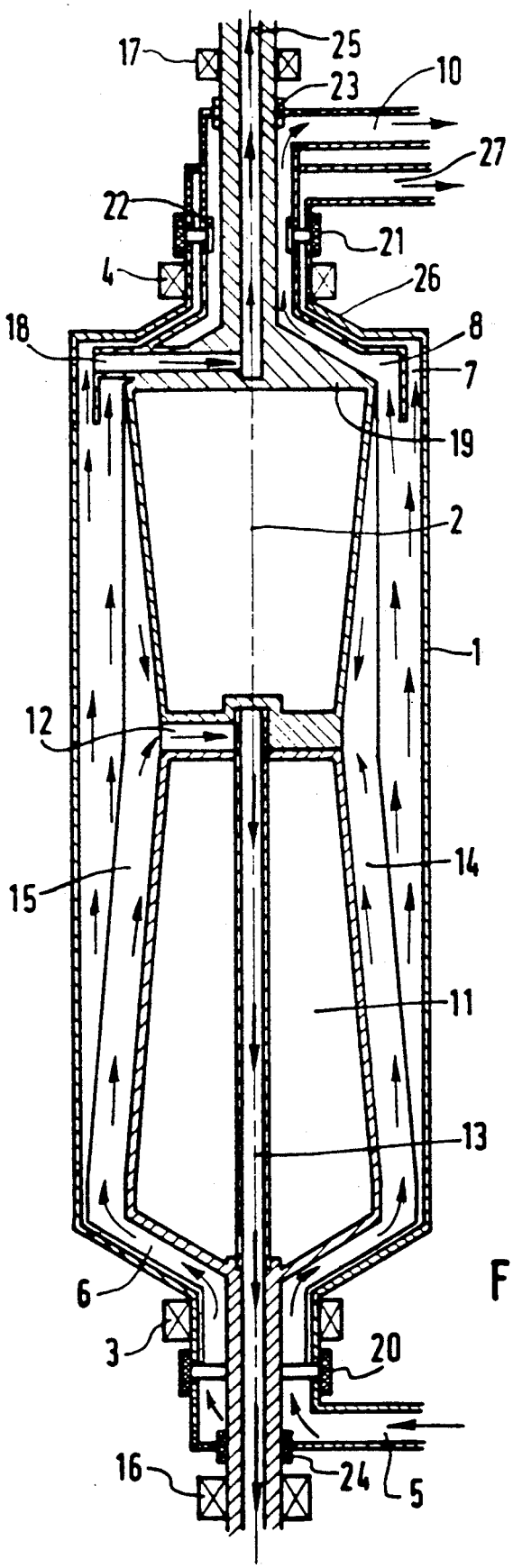
FIG. 2 shows in schematic form, in longitudinal cross-section, an apparatus where the central body is capable of being driven in rotation separately from the chamber of the apparatus.

On the device of FIG. 2 the central body (11) and the inlet (6) and outlet (7) means form an integral unit driven in rotation separately from the chamber. As in FIG. 1, the fixed means (5) and (8) are connected to the movable means (6) and (10) respectively by sealed connections (20–24) and the central body has a diabolo shape that, two oppositely directed cones joined at their smallest diameter ends. This diabolo (11) is also equipped at the periphery with fins (14,15) for entraining the suspension to be cleaned, arranged along generatrices and equidistant from each other. Bearings (16,17) associated with conventional seals (23,24), allow the central diabolo (11) to rotate about the longitudinal axis (2) at an appropriate speed. The run-off (12) provided in the central body forms a movable means for discharging the light fraction and is extended downstream by an evacuation duct (13) arranged along the axis (2). A radial run-off or radial passage means (18) provided in the outlet end (19) allows extraction of the heaviest fraction in the peripheral zone (7), forming the movable means for discharging this heavy fraction. This run-off (18) is extended downstream by an outlet duct (25) arranged along the longitudinal axis (2). Movable means (26) for supplying an auxiliary dilution fluid are provided along the outlet end (19) integral with the central diabolo (11) and are connected via sealed connections (22) to fixed means (27) for supplying the auxiliary dilution fluid. It is important that the characteristic run-off (12) be arranged in the vicinity of the smallest cross-section of the central convergent body (11) and preferably on this point, an inlet radially remote from the axis of the chamber 1, in order to satisfactorily recover the entire light fraction.

The introduction of washing water minimizes, in the case of paper pulps, the losses of fibers which tend to concentrate in the region of the wall with the heavy contaminants.

In the advantageous embodiment of the device of FIG. 2, the unit (18,25) for continuous evacuation of the heavy fraction is associated with devices (26,27) for continuous ejection of washing water which use the space (26) situated between the outlet end (19) linked to the diabolo-shaped central body (11) and the outlet flange of the chamber (1) of the apparatus. In a simplified embodiment, the same devices (18,25) may be used alternately for the discontinuous injection of water for washing the heavy fraction and for discontinuous extraction of the heavy contaminants, the extraction phase being advantageously very short compared to the washing phase, in order to minimize the heavy-fraction losses.

Figure 3:
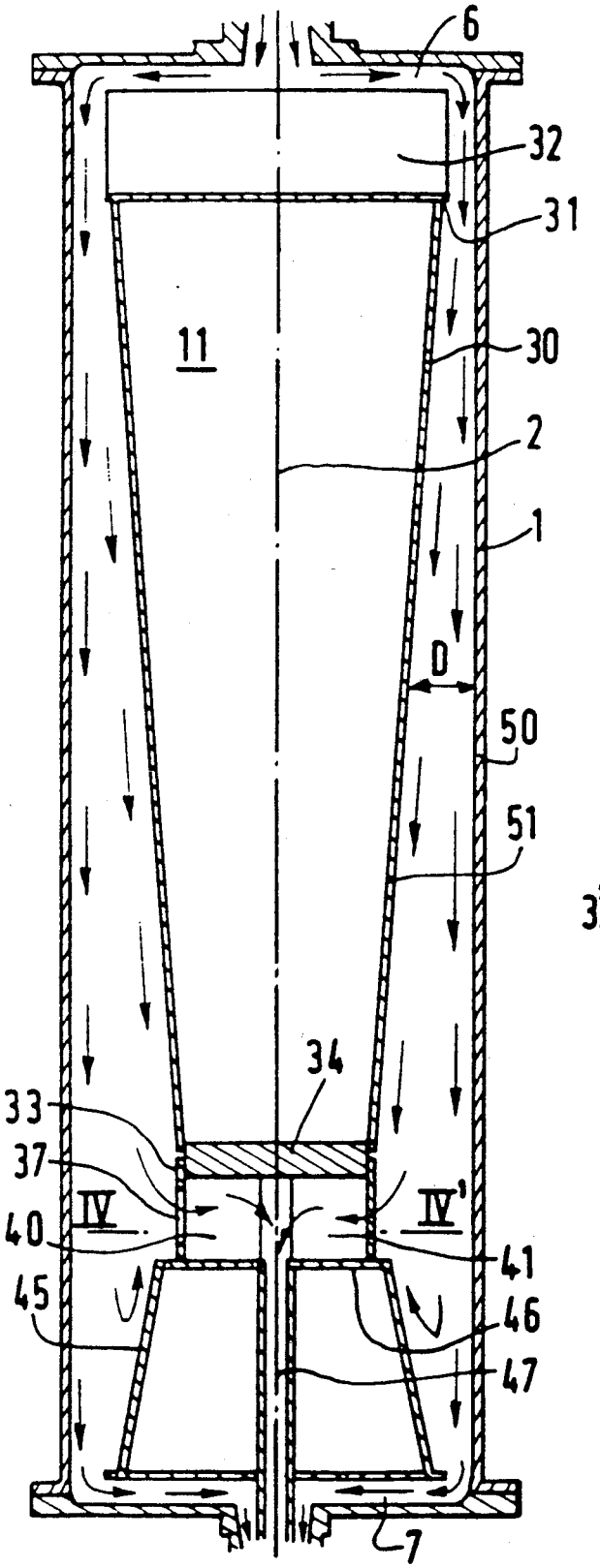

FIG. 3 shows in schematic form and in longitudinal cross-section a device particularly suited to the cleaning of paper suspensions. The inner wall of the chamber (1) is cylindrical. The characteristic diabolo-shaped convergent central body (11) comprises:

a first frustoconical portion (30), tapered towards the outlet (7), occupying more than half the distance between the inlet (6) and the outlet (7); for ease of manufacture and mounting, this frustoconical portion (30) is fixed at its wide part (31) to the feed end (32) with a cylindrical shape and having the oblique channels for injection of the paper pulp; the distance D between the inner wall (50) of the chamber (1) and the wall (51) of the central body (30) thus increases uniformly from the inlet (6) towards the outlet (7);

a second cylindrical portion (33) shrunk (34) onto the tapered end of the first portion (30), in order to define a zone with a smaller cross-section and having at the periphery thereof orifices (35,36,37) and the inner wall (38) of which (see FIG. 4) has radial fins (40,41,42); the orifice (35–37) and fin (40–42) unit forms a run-off unit or radial passage means similar to (12); consequently, as previously (12), the run-off takes place at the low point of the central body (30);

a third frustoconical portion (45), but with a conicity which is opposite to, (30) integral at (46) with the cylindrical portion (33) and which has an axial duct (47) similar to (13), associated with the run-off unit (35–37, 40–42) and intended to extract the light fraction from the suspension.

In a practical embodiment, the cylindrical chamber (1) has an internal diameter of 0.75 m for a length of 2.5 m. The cylindrical inlet portion (32) has a diameter of 0.62 m for a length of 0.2 m. The first frustoconical inlet portion (30) has a length of 1.7 m for a diameter which decreases gradually from 0.6 to 0.36 m. The cylindrical run-off section (33) has a length of 0.2 m for a diameter of 0.36 m. The third frustoconical outlet portion (45) has a length of 0.4 m with a diameter which increases from 0.45 to 0.55 m. Finally, the orifices (35,36) have a diameter of 0.05 m and the axial duct (47) has a diameter of 0.05 m.

Figure 4:
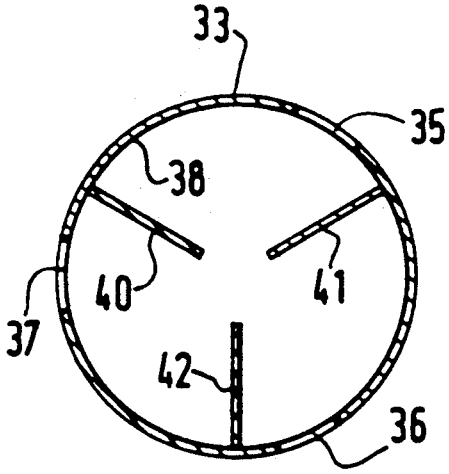
FIG. 4 illustrates, in cross-section, a detail of FIG. 3 (run-off) taken along the axis IV—IV'.

Such a cleaner device according to FIGS. 3 and 4 is able to handle throughputs of the order of five hundred cubic meters per hour and more. In the case where the suspension treated is a paper pulp suspension, the fiber consistency of which is of the order of 0 to 3%, and preferably of the order of 1.5%, the efficiency of this cleaner is comprised between 90 and 99%, with a fiber loss rate of less than 0.5%. Moreover, the energy consumption is considerably smaller compared to that of a plant comprising two conventional cleaners in parallel (21 kw compared to 2×17 kw), a saving to which a saving in pumping energy of 12 kw must be added, i.e. a total of 21 kw compared to 46 kw for a nominal throughput of 450 $m^3$/hour. This considerable reduction is due to the increase in the capacity of the apparatus and to the fact that it is no longer necessary to provide a counterpressure at the outlet of the apparatus.

Furthermore, because of the presence of the central body of revolution, in particular in a diabolo shape, which prevents the formation of the air core and because of the general symmetry of the device in rotation, the detrimental vibrations are eliminated.

The separating device of the invention has numerous advantages compared to those known hitherto, in particular that described in the document EP-B-0,037,347 of the Applicant mentioned in the preamble. There may be mentioned:

the possibility of increasing the diameter of the chamber, in other words its volume, and therefore the production of treated substances and, with equivalent efficiency, the specific productivity;

for the same quantity of treated substance, the possibility of reducing the investment cost;

the reduction in the consumption of energy, by reducing the specific apparatus-driving and pumping powers, because of the reduction in the counterpressure;

the substantial reduction in detrimental vibrations, which improves the lifespan of the mechanical elements (bearings, mountings, joints . . . ).

Consequently, this device may be used successfully for the treatment and cleaning of various suspensions, such as for example suspensions of various paper pulps, waste water or polluted water, water/petroleum suspensions, etc.

We claim:

1. A device for separating particles in a liquid, in which the suspension to be cleaned is supplied to a chamber of revolution (1) rotating about a longitudinal axis (2), of the type comprising:

suspension supply means including first fixed means (5) for supplying the suspension, arranged along the longitudinal axis (2) of a chamber of revolution (1), having first means (6) for deviating the suspension current towards the periphery of the chamber (1);

means for driving said chamber (1) in rotation about its longitudinal axis (2);

second fixed means (9,10) for discharging the cleaned suspension and different separated fractions, arranged along the longitudinal axis (2) of said chamber (1), having second deviating means (7,8), a means (13) for discharging a lightest component being arranged on the longitudinal axis of rotation (2); and said second deviating means (7,8) provided upstream of the second fixed means (9,10) intercepting most of the throughput of the suspension in the region of the periphery of the chamber (1), then deviating it towards the longitudinal axis of rotation (2) so as to recover most of the kinetic energy of rotation;

said second fixed means (9,10) being situated at the opposite end to that of the chamber (1) from the supply means (5,6) and being arranged at the periphery of said chamber (1);

a central body (11) of revolution being arranged inside the chamber, along the longitudinal axis of rotation of said chamber (1), between the first fixed means (5) supplying the suspension and the second fixed means (9–10) discharging said cleaned suspension, said central body of revolution (11):

being mounted for rotation about its axis and having a general diabolo shape including a portion, which, from the inlet means (5,6), converges towards the outlet means (7–10) terminating in a smallest cross-section;

and wherein a radial passage means (12, 33–42) is arranged in the vicinity of the smallest cross-section of said central body of revolution (11) has an inlet radially remote from said axis of rotation and is connected to an axial outlet duct (13, 47) whereby said radial passage means (12, 33–42) provided in the general diabolo-shaped central body of revolution converts the residual energy of the vortex dynamic and static pressures into static pressure which avoids the counterpressure on the outlet side and therefore enables the inlet pressure to be correspondingly reduced resulting in an appreciable saving in energy.

2. The device as claimed in claim 1, wherein the chamber has an inner wall; the central body has a wall; and further a gap D between the inner wall (50) of the chamber (1) and the wall (51) of the central body (11,30) increases gradually from the inlet (5,6) towards the radial passage means (12, 33–42).

3. The device as claimed in claim 1, wherein the general diabolo-shaped central body of revolution (11) comprises three distinct portions, namely:

a first frustoconical portion (30), tapered towards the outlet (7);

a second cylindrical portion (33) connected to the first portion (30), having at its periphery, orifices (35–37) open to the chamber and the radial passage means (40–42);

a third portion (45), also frustoconical, but with a conicity which is opposite to that of the first portion (30), connected to the second cylindrical portion (33) and having an axial duct (47) associated with the radial passage means for extracting a light fraction.

4. The device as claimed in claim 3, wherein the radial passage means consist of circumferentially spaced radial fins (40–42) internally of said cylindrical portion (33) adjacent said peripheral orifices (35–37) within the second cylindrical portion (33) and connected to the axial duct (47).

5. The device as claimed in claim 1, wherein the central convergent body has an inlet and an outlet end; further the inlet and outlet ends are integral with the chamber (1) and are driven in rotation by a single motor at the same speed as the speed of rotation of said chamber (1).

6. The device as claimed in claim 1, wherein the central convergent body (11) is driven in rotation at a speed which is different from that of the chamber (1), but is integral with at least one of the inlet (6) and outlet (7,8) ends of the chamber (1).

7. The device as claimed in claim 6, wherein the general diabolo-shaped central body (11) has on its outer periphery of body (11) fins (14) which are equidistant circumferentially and arranged along a generatrix.

8. The device as claimed in claim 1, wherein said radial passage means comprise at least one fin extending generally radially from said inlet radially remote from said axis of rotation towards said axial outlet duct (13,47).

* * * * *